US006332235B1

(12) United States Patent
Lye

(10) Patent No.: US 6,332,235 B1
(45) Date of Patent: Dec. 25, 2001

(54) PAINT BRUSH HAVING A REPLACEABLE APPLICATION HEAD

(76) Inventor: Sander Lye, 4F, No. 1-3, Chung Hsiao E. Rd., Sec. 5, Taipei (TW)

( * ) Notice: Subject to any disclaimer, the term of this patent is extended or adjusted under 35 U.S.C. 154(b) by 0 days.

(21) Appl. No.: 09/533,655

(22) Filed: Mar. 23, 2000

(51) Int. Cl.[7] ..... B05C 17/00; A46B 7/04
(52) U.S. Cl. ..... 15/244.1; 15/176.1; 15/202
(58) Field of Search ..... 15/176.1, 176.6, 15/202, 209.1, 210.1, 244.1

(56) References Cited

U.S. PATENT DOCUMENTS 2,900,654 * 8/1959 Koltvedt ..... 15/176.6
3,081,475 * 3/1963 Vosbikian et al. ..... 14/244.1
3,131,419 * 5/1964 Vosbikian et al. ..... 15/244.1 X
3,353,203 * 11/1967 Ginter ..... 15/244.1
3,366,988 * 2/1968 Menkin et al. ..... 15/244.1
3,897,603 * 8/1975 Brennenstuhl ..... 15/244.1
4,494,268 * 1/1985 Chu ..... 15/176.1

FOREIGN PATENT DOCUMENTS

2624766 * 12/1987 (FR) ..... 15/176.1

* cited by examiner

*Primary Examiner*—Mark Spisich
(74) *Attorney, Agent, or Firm*—Browdy and Neimark

(57) ABSTRACT

A paint brush comprises a handle, a connection seat, and an application head. The handle is provided at the fastening end thereof with a receiving portion and a retaining slot in communication with the receiving portion. The connection seat is provided with a retaining member and a connection member. The connection seat is detachably fastened at one end thereof with the receiving portion of the handle such that the retaining member of the connection seat is retained in the retaining slot of the handle. The application head is connected at one end thereof with the connection member of the connection seat.

7 Claims, 7 Drawing Sheets

PAINT BRUSH HAVING A REPLACEABLE APPLICATION HEAD

FIELD OF THE INVENTION

The present invention relates generally to a painting tool, and more particularly to a paint brush which has a replaceable application head.

BACKGROUND OF THE INVENTION

As shown in FIG. 1, a prior art paint brush comprises two handle pieces 1 and 2, a fitting seat 3, and an application head 4. The two handle pieces 1 and 2 are provided at the fastening end thereof with a slot 1*a*, 2*a*, whereas the fitting seat 3 is provided with two guide rails 3*a* opposite to each other. The two handle pieces 1 and 2 are fastened with the fitting seat 3 such that the guide rails 3*a* are respectively retained in the slots 1*a* and 2*a* of the two handle pieces 1 and 2 in conjunction with a plurality of pins 5, The application head 4 can be replaced only after the fastening pins 5 are removed from the handle pieces and the fitting seat.

As shown in FIG. 2, another prior art paint brush comprises a handle 6 and an application head 7. The handle 6 is provided at the fastening end thereof with a plurality of retaining holes 6*a*, whereas the application head 7 is provided at the fastening end thereof with a plurality of retaining pins 7*a* corresponding in location and number to the retaining holes 6*a*. The application head 7 is detachably fastened with the handle 6 such that the retaining pins 7*a* are retained in the retaining holes 6*a*. This prior art paint brush is defective in design in that the handle 6 and the application head 7 can not be held together securely by retaining holes 6*a* and the retaining pins 7*a*, which are susceptible to wear resulting from the friction. In addition, both hands of a user of the paint brush are easily tainted with the paint in the midst of replacing the application head 7.

SUMMARY OF THE INVENTION

It is therefore the primary objective of the present invention to provide a paint brush with an application head which can be replaced with ease and speed.

It is another objective of the present invention to provide a paint brush with an application head which can be replaced handily by a person without tainting the hands of the person.

In keeping with the principle of the present invention, the foregoing objectives of the present invention are attained by a paint brush comprising a handle, a connection seat, an application head, and a pushing member. The handle has a grip portion and a connection portion extending from one end of the grip portion and haviving a receiving portion and a retaining slot in communication with the receiving portion. The connection seat is provided with a retaining member and a connection member. The connection seat is disposed in the receiving portion of the connection portion of the handle such that the retaining member of the connection seat is retained in the retaining slot of the connection portion. The application head is connected with the connection member of the connection seat. The pushing member is disposed in the connection seat for pushing the connection seat out of the receiving portion of the connection portion of the handle.

DETAILED DESCRIPTION OF THE INVENTION

Figure 1:
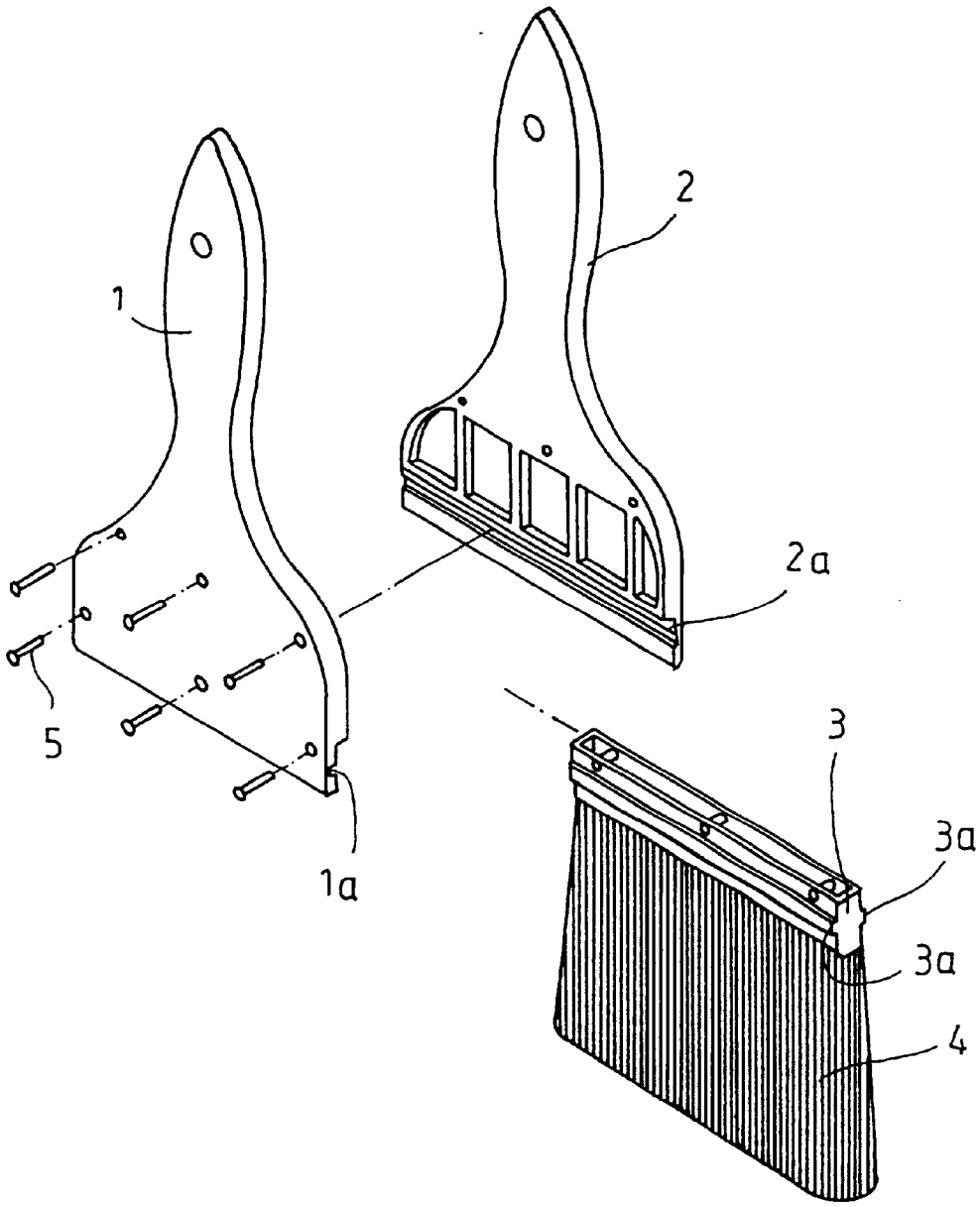
FIG. 1 PRIOR ART
FIG. 1 shows a schematic view of a prior art paint brush.
Figure 2:
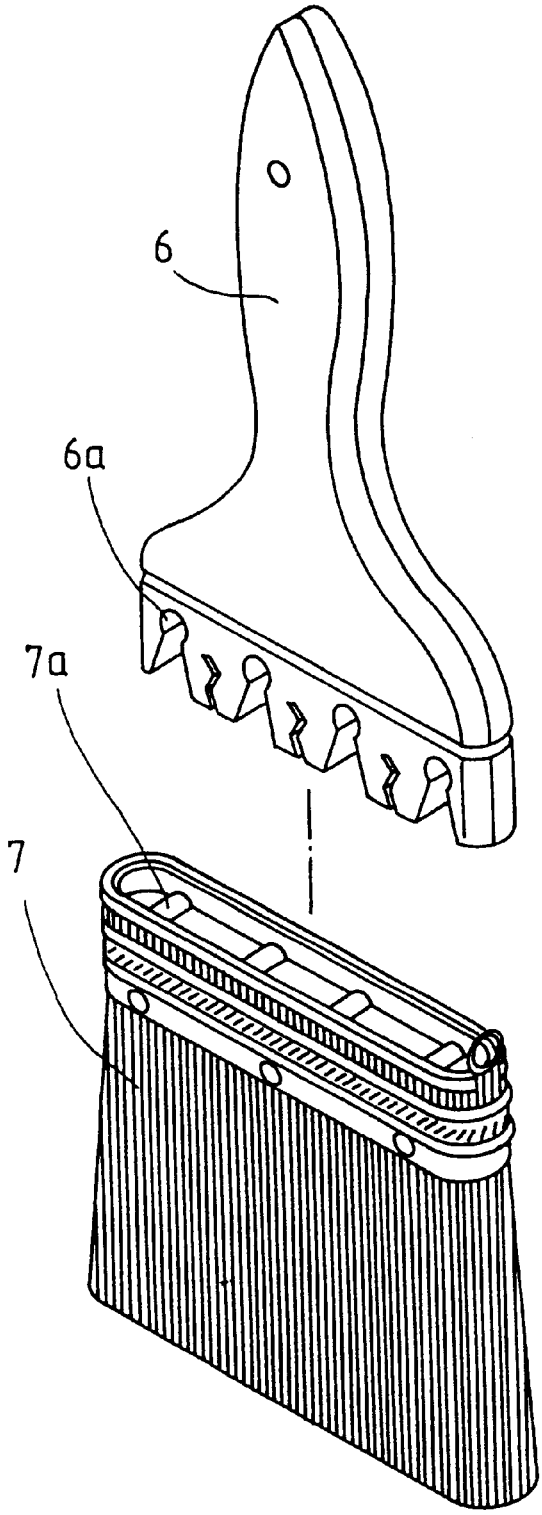
FIG. 2 PRIOR ART
FIG. 2 shows a schematic view of another prior art paint brush.
Figure 3:
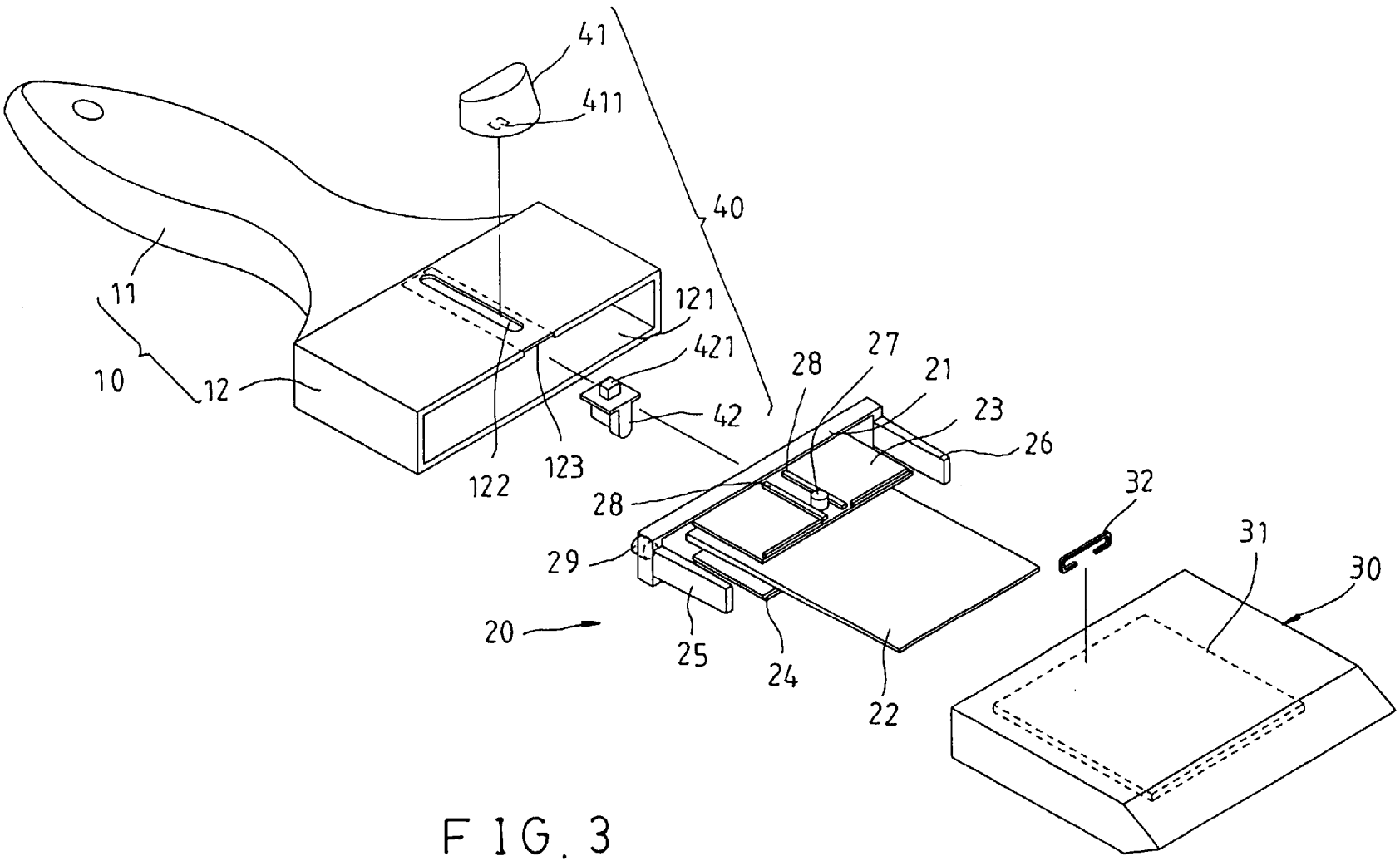
FIG. 3 shows an exploded view of a preferred embodiment of the present invention.
Figure 4:
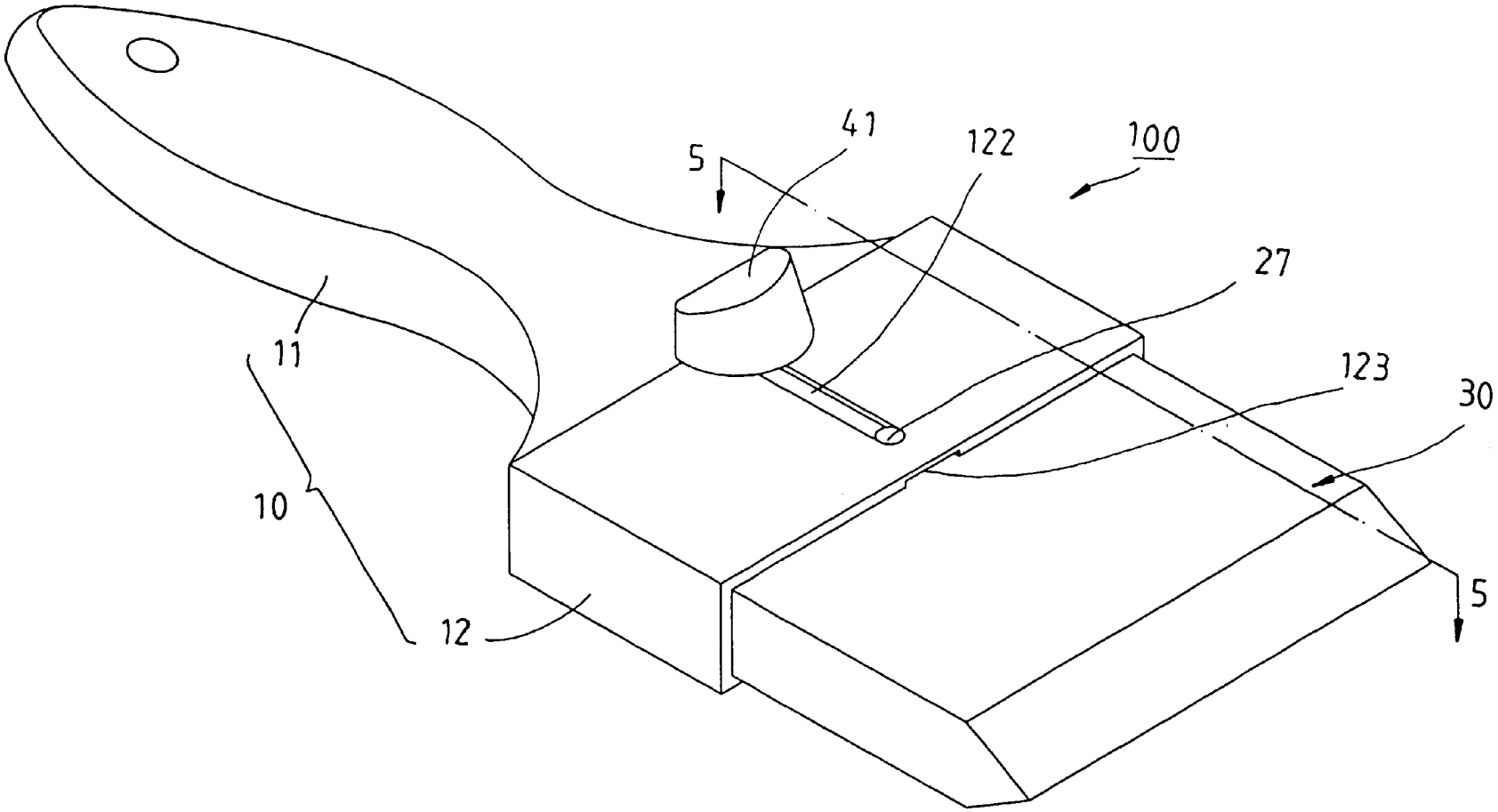
FIG. 4 shows a perspective view of the preferred embodiment of the present invention in combination.
Figure 5:
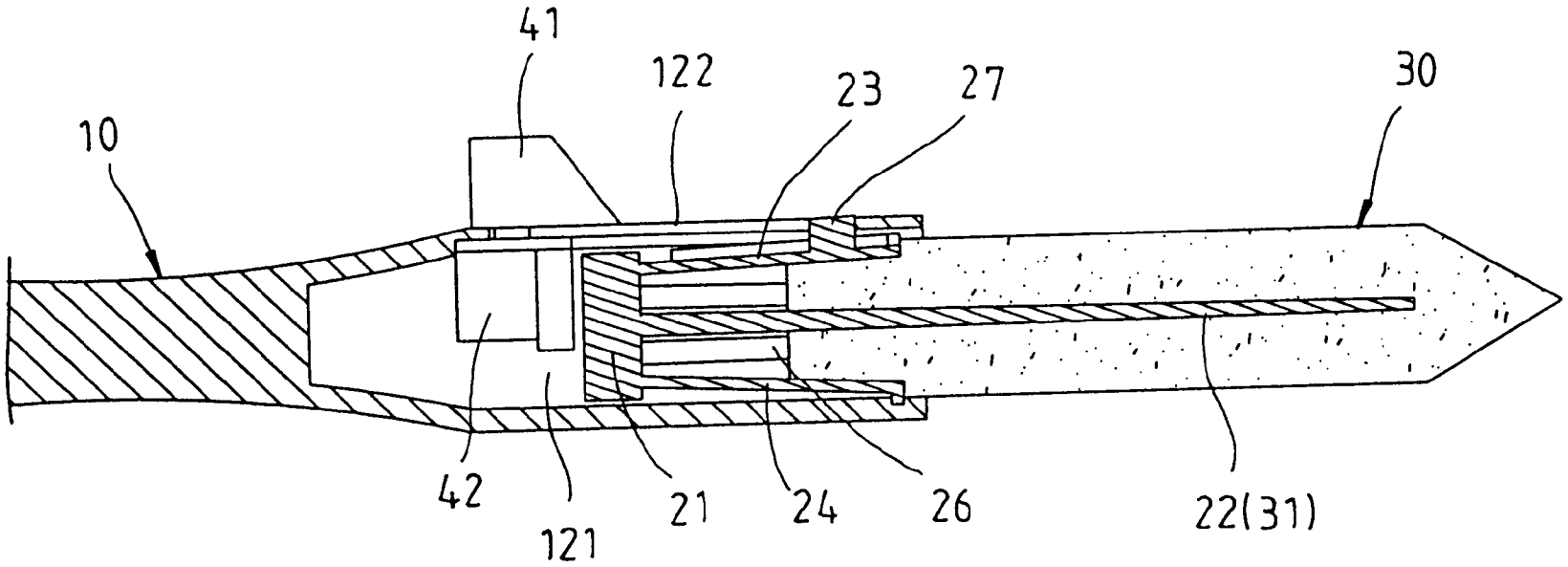
FIG. 5 shows a sectional view taken along the direction indicated by a line 5—5 as shown in FIG. 4.

As shown in FIGS. 3–5, a paint brush 100 embodied in the present invention is formed of a handle 10, a connection seat 20, an application head 30, and a pushing member 40.

The handle 10 has a grip portion 11, and a connection portion 12 which is provided wing a receiving portion 121 and a retaining slot 122 in communication with the receiving portion 121. The receiving portion 121 is provided with a groove 123 parallel to the retaining slot 122.

The connection seat 20 has a push plate 21, which is provided in one side thereof with a connection member 22 extending therefrom, an upper wing plate 23 parallel to the connection member 22, and a lower wing plate 24 parallel to the connection member 22. The connection member 22 is provided with a first press plate 25 and a second press plate 26 opposite to the first press plate 25. The upper wing plate 23 is provided in the outer side thereof with a retaining member 27 which is of a columnar construction and is provided with two guide rails 28 opposite and parallel to each other. The push plate 21 is further provided in other side thereof with an urging pillar 29. The connection seat 20 is received in the receiving portion 121 of the connection portion 12 of the handle 10 such that the retaining member 27 is retained in the retaining slot 122, and that the guide rails 28 cooperate with the groove 123.

The application head 30 is made of an artificial sponge and is provided with a receiving space 31 in which the connection member 22 of the connection seat 20 is received such that the connection member 22 is held securely in place by a fastening member 32. When the application head 30 is engaged with the connection member 22, the two opposite sides of the rear segment of the application head 30 are pressed against by the press plates 25 and 26 of the connection seat 20, thereby locating the application head 30 securely in place so as to prevent the application head 30 from moving aside. As the connection seat 20 is disposed in the receiving portion 121 of the connection portion 12 of the handle 10, the application head 30 is clamped by the upper wing plate 23 and the lower wing plate 24.

The pushing member 40 is formed of a guide block 41 and a driven block 42. The guide block 41 is located on the outer surface of the handle 10 and is provided in the underside thereof with a connection hole 411. The driven block 42 is disposed in the receiving portion 121 and is provided on the top thereof with a protrusion 421, which is inserted into the connection hole 411 of the guide block 41 via the retaining slot 122. The driven block 42 moves along with the guide block 41 to push the connection seat 20 out of the receiving portion 121 of the connection portion 12 of the handle 10.

Figure 6:
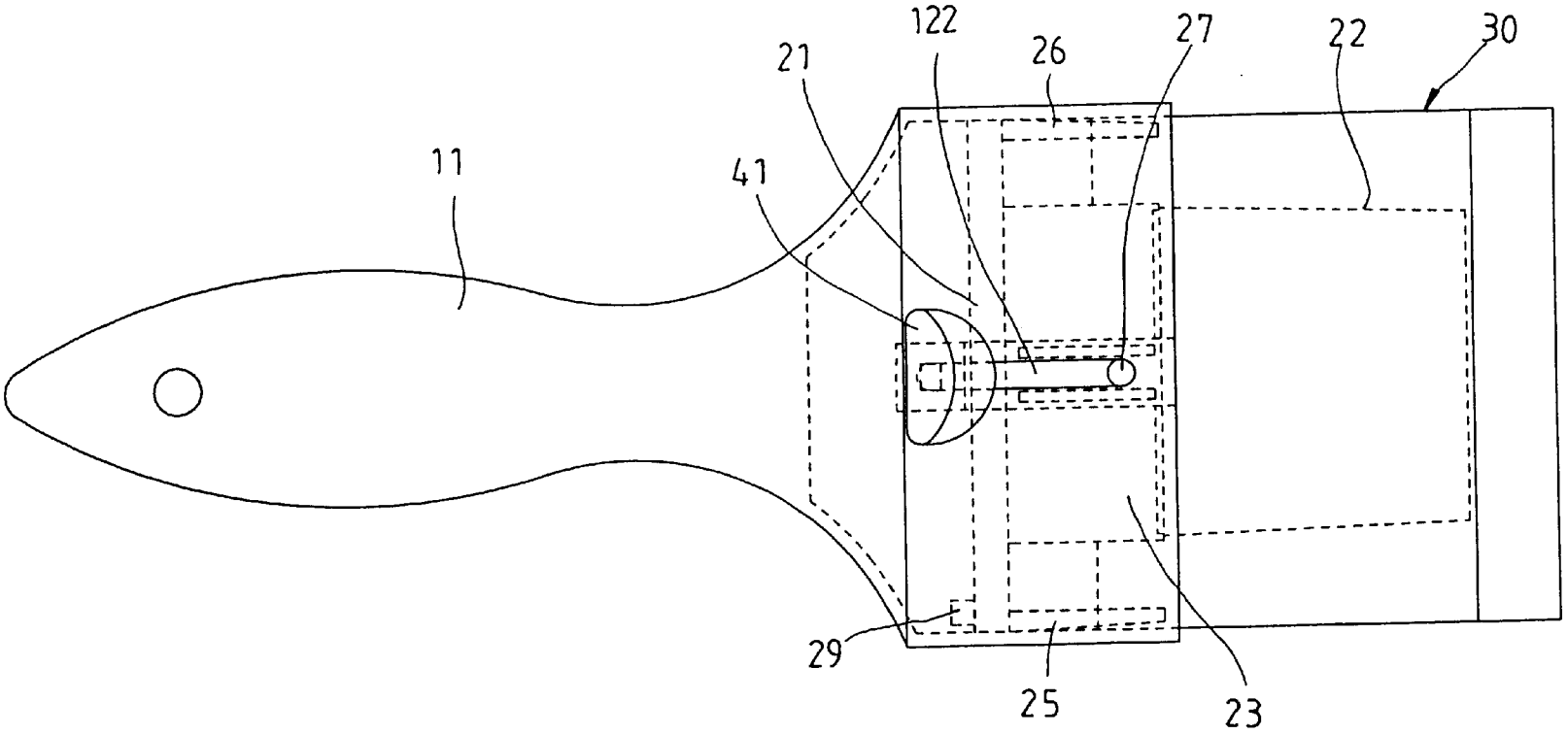
FIG. 6 shows a top schematic view of the preferred embodiment of the present invention in combination.

As illustrated in FIG. 3, the driven block 42 is first inserted into the receiving portion 121 such that the protrusion 421 is jutted out of the retaining slot 122, and that the protrusion 421 is then inserted into the connection hole 411 of the guide block 41. As a result, the pushing member 40 can be pushed to slide along the longitudinal direction of the retaining hole 122. The fastening of the protrusion 421 with the connection hole 411 can be reinforced by an adhesive, which is coated on the protrusion 421 or the inner wall of the connection hole 411. Before the connection seat 20 is inserted into the receiving portion 121 of the handle 10, the application head 30 is first fastened with the connection member 22 by the fastening member 32 such that the application head 30 is confined by the press plates 25 and 26. Thereafter, the connection seat 20 is inserted into the receiving portion 121 such that the retaining member 27 is retained in the retaining slot 122, as shown in FIGS. 4 and 6.

Figure 7:
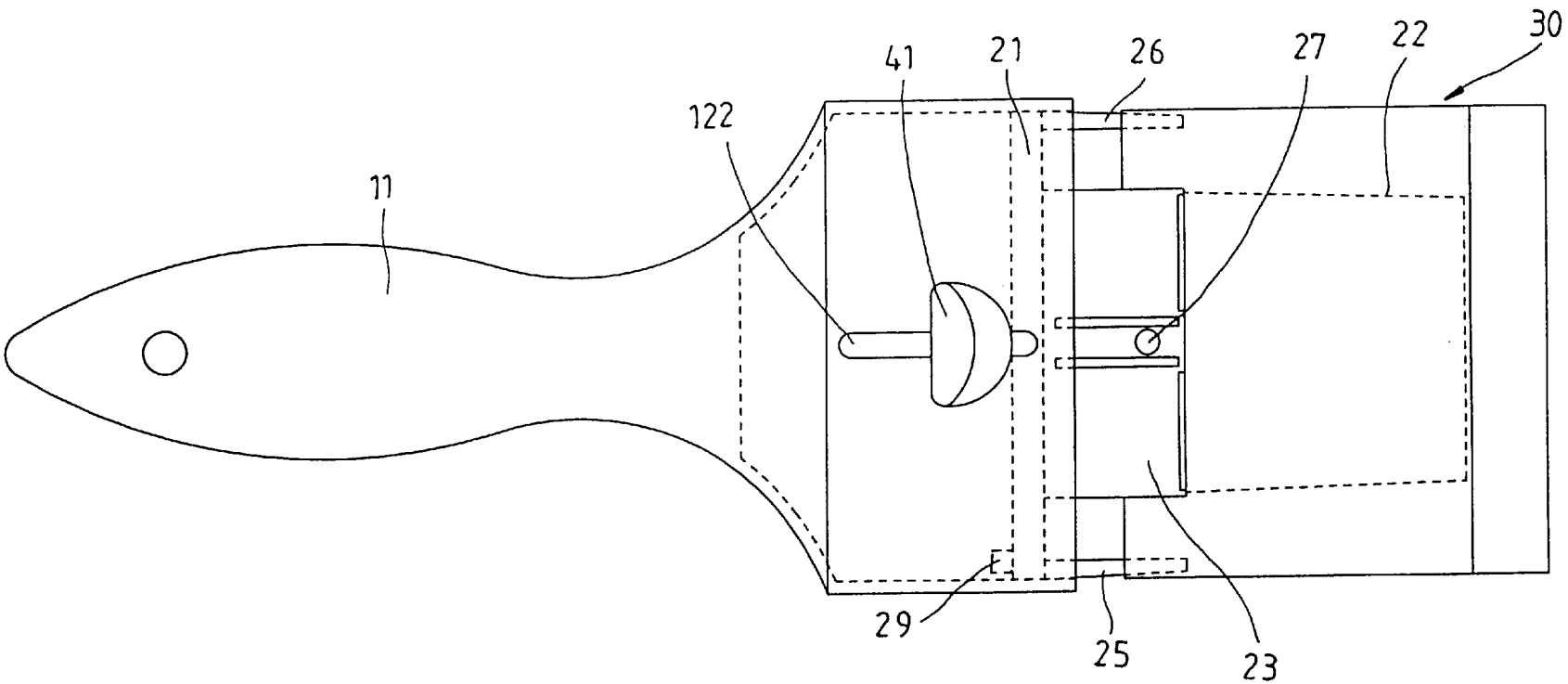
FIG. 7 shows a schematic view of the replacing of the application head of the preferred embodiment of the present invention.

As illustrated in FIG. 7, the connection seat 20 can be separated from the handle 10 for the purpose of replacing the application head 30. As the retaining member 27 is pressed downward to push the guide block 41 to move out of the receiving portion 121, the driven block 42 moves along with the guide block 41 to push the push plate 21 of the connection seat 20 to move in the direction away from the handle 10. The connection seat 20 is then pulled out of the receiving portion 121 with fingers holding the press plates 25 and 26. In the midst of replacing the old application head 30 with a new one, both hands of the user of the paint brush 100 of the present invention are not susceptible to being tainted by the paint residue remaining on the old application head 30. In addition, the application head 30 of the paint brush 100 of the present invention can be replaced with ease and speed.

What is claimed is:

1. A paint brush comprising:

a handle having a grip portion and a connection portion whereby said connection portion is provided with a receiving portion and a retaining slot in communication with said receiving portion;

a connection seat having a retaining member and a connection member, said connection seat being removably received in said receiving portion of said handle such that said retaining member is retained in said retaining slot;

an application head fastened at one end thereof with said connection member of said connection seat; and a pushing member slidably disposed in said connection portion such that said pushing member can be caused by an external force to slide in said retaining slot to push said connection seat to move in a direction away from said receiving portion of said handle.

2. The paint brush as defined in claim 1, wherein said application head is made of an artificial sponge.

3. The paint brush as defined in claim 2, wherein said application head has a receiving space; wherein said connection member of said connection seat is provided with two wing plates opposite to each other and separated from each other by a distance whereby said application head and said connection seat are held together such that said connection member is received in said receiving space of said application head, and that said application head is clamped by said two wing plates of said connection member of said connection seat.

4. The paint brush as defined in claim 3, wherein said retaining member of said connection seat is of a columnar construction and is disposed on one of said two wing plates such that said retaining member is retained in said retaining slot.

5. The paint brush as defined in claim 4, wherein said one wing plate is provided with at least one guide rail; wherein said receiving portion of said handle is provided therein with a groove cooperative with said guide rail to enable said connection seat to displace with stability.

6. The paint brush as defined in claim 1, wherein said application head is further fastened with said connection member by a fastening member.

7. The paint brush as defined in claim 1, wherein said pushing member is formed of a guide block and a driven block, said guide block being disposed on said handle, said driven block being disposed in said receiving portion and used for pushing said connection seat.

* * * * *